US011608946B2

(12) United States Patent
Salzinger et al.

(10) Patent No.: US 11,608,946 B2
(45) Date of Patent: Mar. 21, 2023

(54) TRAVEL SOLAR LIGHTING DEVICES

(71) Applicant: MPOWERD Inc., Brooklyn, NY (US)

(72) Inventors: John Salzinger, Brooklyn, NY (US); Seungah Jeong, Brooklyn, NY (US)

(73) Assignee: MPOWERD, Inc., Brooklyn, NY (US)

( * ) Notice: Subject to any disclaimer, the term of this patent is extended or adjusted under 35 U.S.C. 154(b) by 0 days.

(21) Appl. No.: 17/688,677

(22) Filed: Mar. 7, 2022

(65) Prior Publication Data

US 2022/0186894 A1 Jun. 16, 2022

Related U.S. Application Data

(63) Continuation of application No. 16/574,912, filed on Sep. 18, 2019, now Pat. No. 11,268,663.

(60) Provisional application No. 62/733,379, filed on Sep. 19, 2018.

(51) Int. Cl.

| | |
|---|---|
| ***F21L 4/02*** | (2006.01) |
| ***F21L 4/08*** | (2006.01) |
| ***F21V 15/01*** | (2006.01) |
| ***F21V 23/04*** | (2006.01) |
| ***H04R 1/02*** | (2006.01) |
| ***H04R 1/40*** | (2006.01) |
| ***H04R 3/12*** | (2006.01) |
| ***F21V 33/00*** | (2006.01) |
| *F21Y 105/18* | (2016.01) |
| *F21Y 115/10* | (2016.01) |

(52) U.S. Cl.

CPC ..... *F21L 4/02* (2013.01); *F21L 4/08* (2013.01); *F21V 15/012* (2013.01); *F21V 23/0435* (2013.01); *F21V 23/0485* (2013.01); *F21V 33/0056* (2013.01); *H04R 1/023* (2013.01); *H04R 1/028* (2013.01); *H04R 1/403* (2013.01); *H04R 3/12* (2013.01); *F21Y 2105/18* (2016.08); *F21Y 2115/10* (2016.08)

(58) Field of Classification Search

CPC .. F21L 4/02; F21L 4/08; F21V 15/012; F21V 23/0435; F21V 23/0485; F21V 33/056; H04R 1/023; H04R 1/028; H04R 1/403; H04R 3/12; F21Y 2105/18; F21Y 2115/10

See application file for complete search history.

(56) References Cited

U.S. PATENT DOCUMENTS

2017/0241636 A1* 8/2017 Mosley ..... H04B 1/3827
2019/0011089 A1 1/2019 Whiting et al.

* cited by examiner

*Primary Examiner* — Anne M Hines
(74) *Attorney, Agent, or Firm* — Pearl Cohen Zedek Latzer Baratz LLP

(57) ABSTRACT

Lighting devices are described and may include a housing, a solar panel, and at least one speaker. The housing may include a cover and a base coupled to the cover. The lighting device may also include at least one rechargeable battery, a microprocessor, and a plurality of light sources, such as LEDs, configured to emit light towards the cover. The solar panel, the rechargeable battery, the microprocessor, the speaker, and the plurality of light sources may be in electronic communication with one another. Further, for example, the microprocessor may be configured to control at least one operating mode of the plurality of light sources and at least one operating mode of the speaker.

15 Claims, 3 Drawing Sheets

TRAVEL SOLAR LIGHTING DEVICES

CROSS-REFERENCE TO RELATED APPLICATIONS

This application is a continuation of U.S. application Ser. No. 16/574,912, filed on Sep. 18, 2019, which claims priority to U.S. Provisional Application No. 62/733,379, filed on Sep. 19, 2018, each of which is incorporated by reference herein in its entirety.

TECHNICAL FIELD

The present disclosure generally relates to portable lighting devices. More particularly, the present disclosure includes portable, rechargeable lighting devices that have acoustic features and/or wireless connectivity.

BACKGROUND

Portable lighting devices have uses in a variety of situations, including during travel and in situations of limited or no power access.

SUMMARY

The present disclosure includes lighting devices, including, e.g., solar-powered lighting devices. The lighting device, according to some examples herein, may include a housing including a cover and a base coupled to the cover, wherein the base encloses a first chamber and the cover encloses a second chamber. Further, for example, the lighting device may comprise a solar panel coupled to an outer surface of the housing; at least one speaker, which may be disposed within the first chamber of the housing; at least one rechargeable battery; a microprocessor; and a plurality of light sources. The light sources may be disposed outside the first chamber and/or within the second chamber, the plurality of lights configured to emit light towards the cover. Further, the solar panel, the rechargeable battery, the microprocessor, the speaker, and the light sources may be in electronic communication with one another; and the microprocessor may be configured to control at least one operating mode of the light sources and at least one operating mode of the speaker. The lighting device may include two speakers, for example, optionally facing in different directions. The housing may have a tapered shape.

Further, for example, the housing may include a section between the cover and the base, the section being radially outward of the speaker(s). The section may comprise a material or combination of materials that permit the passage of sound therethrough. For example, the section may comprise a textile material. The light sources may comprise light-emitting diodes (LEDs) arranged at regular intervals from each other, e.g., 6 to 24 LEDs, or 10 to 18 LEDs. The LEDs may be arranged in an annular configuration. According to some aspects of the present disclosure, the lighting device may be configured to receive user input wirelessly from an external electronic device, such as, e.g., a smart phone or other mobile device. For example, the lighting device may include a wireless communication to enable Bluetooth.

The present disclosure also includes a lighting device comprising a housing, wherein the housing includes a cover that is at least partially transparent or translucent, and a base coupled to the cover, wherein the base encloses a chamber. The lighting device may further comprise a solar panel coupled to an outer surface of the housing; at least one speaker disposed within the chamber; at least one rechargeable battery; a microprocessor; and a plurality of light-emitting diodes (LEDs) facing an inner surface of the cover. The solar panel, the rechargeable battery, the microprocessor, the speaker, and the plurality of LEDs may be in electronic communication with one another; and the microprocessor may be configured to control at least one operating mode of the plurality of LEDs and at least one operating mode of the speaker. In at least one example, the chamber is a first chamber, and the cover encloses a second chamber outside the first chamber. Optionally, the plurality of LEDs may be within the second chamber. The at least one operating mode of the speaker may include generating white noise, generating a natural sound, playing music, emitting an alarm, or a combination thereof. Additionally or alternatively, the at least one operating mode of the plurality of LEDs may include adjusting an intensity of light generated by the LEDs, changing colors of the LEDs, or a combination thereof. For example, the plurality of LEDs may include at least one white LED and at least one RGB LED. The lighting device may further comprise a touchscreen configured to receive user input and transmit the user input to the microprocessor, e.g., to control the operating modes.

The present disclosure also includes a lighting device comprising a housing that includes a base enclosing a first chamber; a cover enclosing a second chamber outside of the first chamber; and a section between the cover and the base. The section may comprise a textile material that permits the passage of sound therethrough. The lighting device may further comprise a solar panel coupled to an outer surface of the housing; at least one speaker disposed within the first chamber and radially inward of the section; at least one rechargeable battery; a microprocessor; and a plurality of light-emitting diodes (LEDs) within the second chamber, the plurality of LEDs including white LEDs and RGB LEDs; wherein the solar panel, the rechargeable battery, the microprocessor, the speaker, and the plurality of LEDs are in electronic communication with one another; and wherein the microprocessor is configured to control at least one operating mode of the plurality of light sources and at least one operating mode of the speaker. According to some aspects of the present disclosure, the lighting device further comprises a separator between the cover and the base, the separator and the base together forming the first chamber. The housing may have a tapered shape, e.g., a cross-sectional dimension of the cover being less than a cross-sectional dimension of the section. Further, for example, the at least one operating mode of the speaker may include generating white noise, a natural sound or both; and the at least one operating mode of the plurality of LEDs may include changing colors of the LEDs.

Any of the foregoing features of lighting devices may be used in combination with each other in yet additional examples as discussed further herein.

BRIEF DESCRIPTION OF THE DRAWINGS

The accompanying drawings, which are incorporated in and constitute a part of this specification, illustrate various exemplary embodiments and together with the description, serve to explain the principles of the present disclosure.

DETAILED DESCRIPTION

The terminology used in this disclosure may be interpreted in its broadest reasonable manner, even though it is being used in conjunction with a detailed description of certain specific examples of the present disclosure. Both the foregoing general description and the following detailed description are exemplary and explanatory only and are not restrictive of the features, as claimed.

The singular forms "a," "an," and "the" include plural reference unless the context dictates otherwise. The terms "approximately" and "about" refer to being nearly the same as a referenced number or value. As used herein, the terms "approximately" and "about" generally should be understood to encompass ±5% of a specified amount or value. The terms "comprises," "comprising," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. The term "exemplary" is used in the sense of "example" rather than "ideal."

The present disclosure includes portable solar-powered lighting devices with a speaker, wireless communication, and/or charging capabilities. For example, the lighting devices herein may be configured as solar-powered rechargeable light/speaker/battery packs. One or more features of the lighting devices may provide benefits for travel use, such as, e.g., dimensions (e.g., compact size and/or shape), weight (e.g., relatively light weight), and/or functionality (e.g., speaker, different light operating modes, different sound operating modes, and/or wireless connectivity).

Figure 1A:
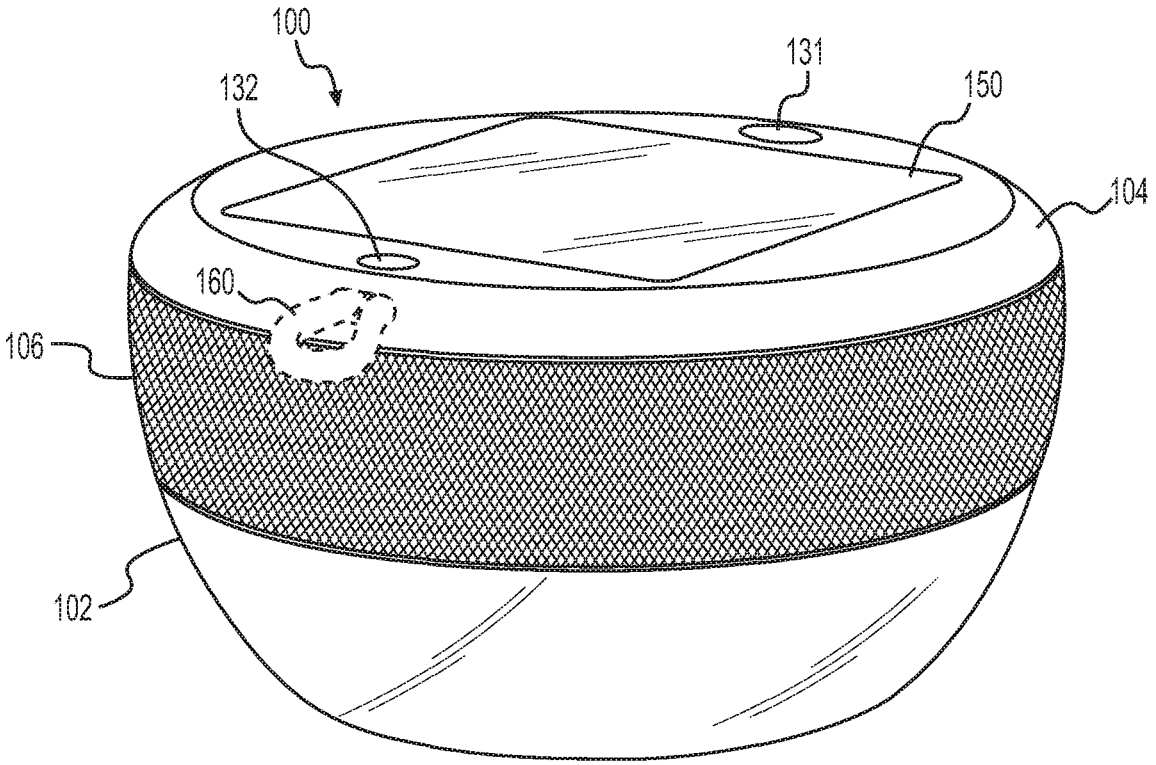
FIGS. 1A-1B show an exemplary lighting device, according to some aspects of the present disclosure.
Figure 1B:
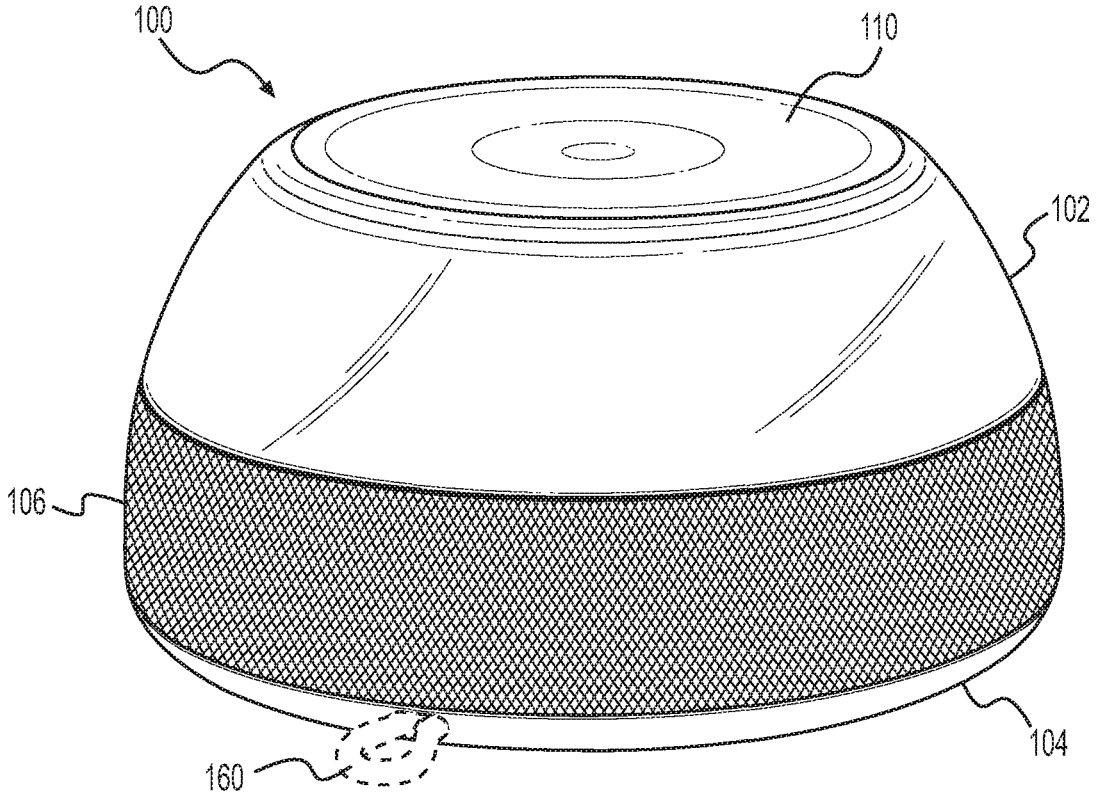

FIGS. 1A and 1B show an exemplary lighting device 100 according to some aspects of the present disclosure. As shown, the lighting device 100 comprises a housing that includes a cover 102, a base 104, and a section 106 between the cover 102 and the base 104. The various portions of the housing may be separate components configured to attach together (permanently attached or removably attached), or the various portions may be integral with one another. In some examples, the lighting device is not inflatable, e.g., the lighting device does not include an inflatable bladder. In at least one example, the lighting device includes a cover 102 and a base 104 without a section 106 between the cover 102 and the base 104 (e.g., the cover 102 being configured to attach to the base 104).

According to some aspects of the present disclosure, the section 106 may be configured to allow sound to pass therethrough, e.g., the sound being generated by a speaker contained within the housing. Additionally or alternatively, the cover 102 may be configured to allow light to pass therethrough, e.g., the light being generated by one or more light sources contained within the housing.

The lighting devices herein may have any suitable shape. The cross-sectional shape may be circular, as shown in FIGS. 1A and 1B, or any other cross-sectional shape such as, e.g., polygonal (triangular, square, rectangular, pentagonal, etc.), oval, or other suitable shape. Further, the cross-sectional shape and/or dimensions optionally may vary. For example, the lighting device 100 is depicted as having a rounded edges and a tapered exterior, such that the cross-sectional dimension of the section 106 is greater than the cross-sectional dimension of each of the cover 102 and the base 104. That is, the cross-sectional dimension of the housing is at a maximum at or proximate the junction between, or transition from, the section 106 to the base 104. In other examples contemplated herein, the lighting device may have a cross-sectional dimension that does not vary among the cover 102, base 104, and section 106 (e.g., a housing that is cubic, rectangular, cylindrical, etc.).

The housing may comprise a polymer or combination of polymer materials. For example, the base and/or other components of the lighting device 100 may comprise acrylonitrile butadiene styrene (ABS), polypropylene, polyethylene, silicone, polyurethane, including thermoplastic polyurethane (TPU), polyvinylchloride (PVC). In at least one example, the cover 102 and/or the base 104 comprises ABS. For example, the base 104 may comprise rigid ABS, optionally with a soft-touch polymer layer overmolded, and/or the cover 102 may comprise ABS configured to allow light to pass therethrough (e.g., the cover 102 being transparent or translucent). For example, the cover 102 may comprise frosted ABS, which may have any desired color (e.g., white, clear, beige, yellow, orange, red, blue, green, violet, grey, etc.). These materials are exemplary only; additional polymers and other suitable materials including glass (e.g., glass with shatter resistance) are also contemplated and encompassed herein. The material used to form the cover 102 may allow for even dispersion of light.

The section 106 overlaying speaker components of the device 100 may be at least partially porous to facilitate sound transmission. In at least one example, the section 106 comprises a polymer wall with a plurality of holes (e.g., a perforated ABS sheet) covered with fabric or other textile material. The textile material may be water-resistant and may have a texture and/or weave that promotes transmission of sound. The textile (e.g., fabric) may be coupled to, e.g., permanently adhered to, the polymer wall. In some examples herein, the lighting device 100 includes a handle 160 coupled to the housing and/or attached to an interior of the device 100 and extending through the housing. The handle 160 may be flexible, e.g., comprising a flexible polymer or textile, and may be adjustable. In some examples, the lighting device 100 does not include a handle.

Figure 2:
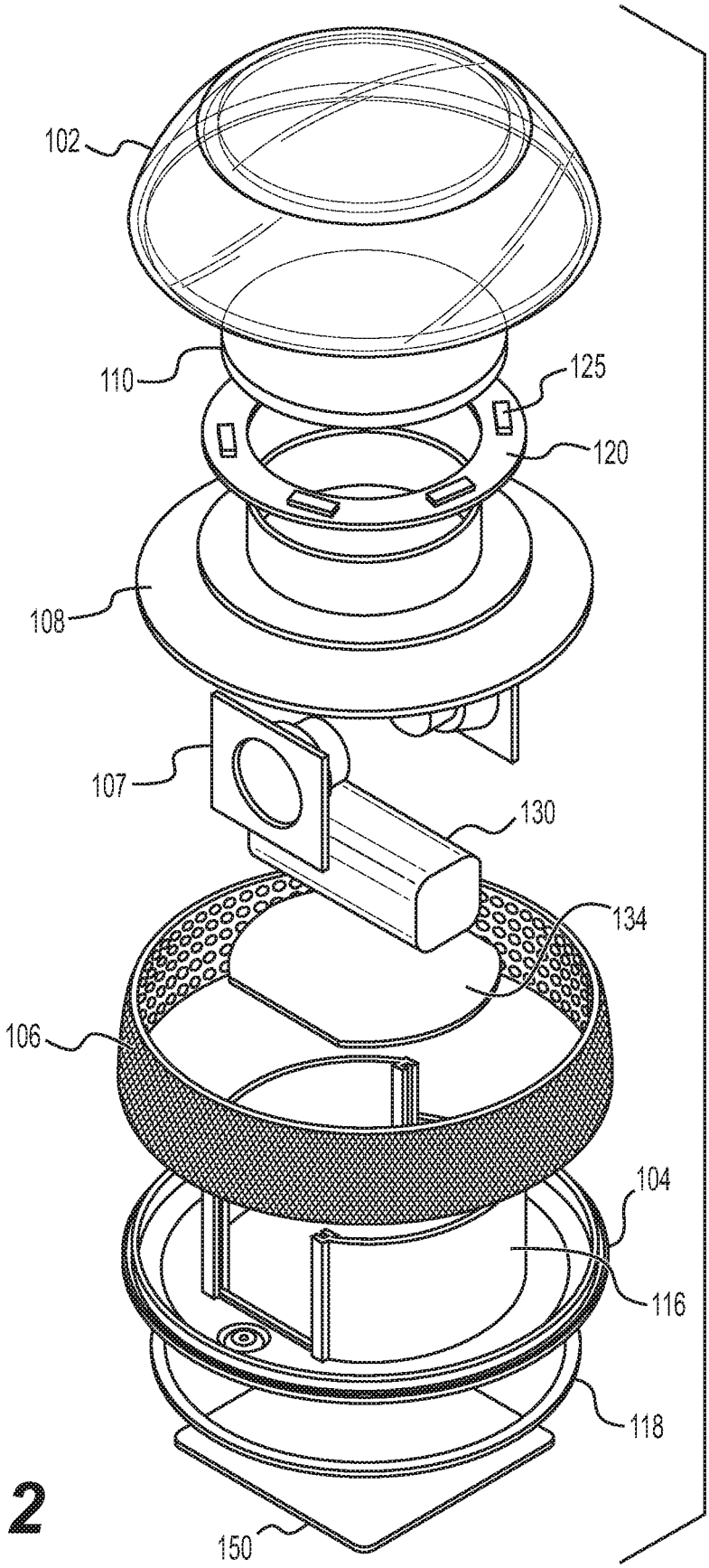
FIG. 2 shows an exploded view of the exemplary lighting device of FIGS. 1A-1B.

Further referring to FIGS. 1A and 1B, the lighting device 100 includes at least one solar panel 150 coupled to, or integrated into, the outer surface of the base 104, e.g., to allow the solar panel 150 to be exposed to natural and/or artificial light for charging/recharging. Any suitable solar panel(s) 150 may be used in the lighting device 100. In some examples, the solar panel 150 may comprise silicon, e.g., monocrystalline or polycrystalline silicon. The solar panel(s) 150 may be coupled to an outer surface of the base 104, optionally backed by a support material such as polycarbonate or other plastic or polymer. Alternatively, the base 104 may include a recess for receiving the solar panel(s) 150 and optionally one or more apertures to allow for electronic wiring for connecting the solar panel(s) 150 to electronic components contained within the housing. Optionally, the base 104 may be coupled to a support 118, such as a flexible pad or pads, which may comprise a gripping material such as silicone or rubber. For example, the support 118 may have an annular shape as shown in FIG. 2. Additionally or alternatively, the base 104 may be coupled to a plurality of supports 118, e.g., in the form of pads or "feet," which may assist in gripping a surface and avoid unintended sliding of the lighting device 100.

The outermost surface of the solar panel(s) 150 may include a protective layer such as a film or other material to protect the surface of the solar panel(s) 150 from damage while still permitting exposure to sunlight for generating power. In at least one example, the solar panel(s) 150 is covered with a protective layer comprising a laminate. Exemplary voltages of the solar panel 160 may generally range from about 4V to about 8V, e.g., about 5V, about 6V, or about 7V, but other voltages are encompassed by the disclosure herein.

The lighting device 100 may include one or more user interfaces, such as one or more buttons, dials, touchscreens, switches, etc., configured to receive user input for controlling different functionalities of the lighting device. Additionally or alternatively, the lighting device 100 may be configured to accept user input wirelessly as discussed further below. In some examples, the lighting device includes a plurality of user elements. As shown in FIG. 1A, the lighting device 100 is shown with first and second user elements, e.g., first button 131 and second button 132, as well as a third user element, e.g., touchscreen 110. In other examples, the lighting device 100 includes one user element (e.g., first button 131), or two user elements (e.g., first and second buttons 131, 132; or first button 131 and touchscreen 110).

The first and second buttons 131, 132 each may comprise a polymer, such as ABS, overlaying electronic components, and may have the same or different color than the base 104 and/or other portions of the housing. The first button 131 may be used to control different features of the device 100 than the second button 132. Exemplary features that may be controlled by the first and second buttons 131, 132 may include, for example, turning the touchscreen 110 on and off, turning light sources on and off, turning wireless communication features on and off, and/or to selecting among different operating modes of the lighting device 100. Exemplary wireless communication protocols that may be used include, but are not limited to, Bluetooth, a near-field communication (NFC) protocol, Zigbee, a RF communication protocol, Wi-Fi, and combinations thereof. For example, the lighting device 100 may be Bluetooth connected and/or Wi-Fi enabled, e.g., to permit third-party connectivity such as communicating with Google Home/Assistant, Apple HomePod/Siri, Amazon Echo/Alexa, and/or apps like IFTTT.

In at least one example, the first button 131 may be configured to turn the touchscreen 110 on and off, and the second button 132 may be configured to activate and terminate wireless communication, e.g., Bluetooth. Thus, for example, a first press of the first button 131 may turn the touchscreen 110 on, and a second press of the first button 131 may turn the touchscreen 110 off. Similarly, a first press of the second button 132 may activate Bluetooth capability, and a second press of the second button 132 may terminate Bluetooth. The first button 131 and/or the second button 132 may include an indicator light to indicate when a feature of the device 100 is activated (e.g., the indicator light being illuminated when Bluetooth is activated).

According to some aspects of the present disclosure, the touchscreen 110 may be touch sensitive to allow a user to select among various options and features of the lighting device 100. The touchscreen optionally may include a graphical user interface (GUI). For example, the touchscreen may provide an indication of the amount of power remaining in the device 100, e.g., as a percentage and/or by a progress indicator (e.g., shaded portion within a boundary, or a series of colored bars or lights). In the case of a progress indicator, the correspondence between the shaded portion or number of colored bars or lights and the battery charge may include specified ranges or thresholds of the battery. Additionally or alternatively, the touchscreen may include a menu that allows a user to select among different operating modes. In some examples, the touchscreen responds to touch in order to select among a series of operating modes. Selecting different operating modes may be achieved by the number, frequency, and/or location the touchscreen 110 is touched (e.g., one touch in the center selects a first operating mode, a second touch in the center selects a second operating mode, one touch at the periphery selects a third operating mode, a touch of at least 2 seconds selects a fourth operating mode, etc.). According to some aspects of the present disclosure, the touchscreen 110 may serve as a touch sensitive snooze button, e.g., for using the lighting device 100 as an alarm clock.

The cover 102 may be configured to allow a user to access the touchscreen 110. For example, the cover 102 may include a touch sensitive portion overlaying the touchscreen, or the cover 102 may include an aperture or window corresponding to the size and shape of the touchscreen 110, such that the cover 102 borders the touchscreen 110. In some examples herein, the lighting device does not include a touchscreen 110. In such cases, the cover 102 need not be touch sensitive and may enclose the entire upper portion of the lighting device 100.

The lighting devices herein may contain a battery 130, e.g., a rechargeable battery, in electronic communication with the solar panel(s) 150 and/or one or more other electronic components (see, e.g., FIG. 2). The one or more electronic components may comprise, for example, a printed circuit board (PCB) 134 that includes one or more of a current regulator, an integrated circuit chip, and/or a microprocessor, one or more light sources such as light-emitting diodes (LEDs) 125, and one or more speakers 107.

The battery 130 may be in communication with the solar panel(s) 150, such that the battery 130 may store power generated by the solar panel(s) 150. The battery 130 also may be in communication with the LEDs 125 in order to supply power to the LEDs 125. While omitted from the FIG. 2 for purposes of simplicity, the lighting device 100 may have electrical connections to supply power from the battery 130 to the LEDs 125. The battery 130 may have any suitable capacity. In some examples herein, the battery 130 may have a capacity of from about 1500 mAh to about 3500 mAh or from about 2000 mAh to about 3000 mAh, e.g., about 2500 mAh or about 3000 mAh. The battery 130 may employ any suitable chemistry or composition (e.g., lithium-ion, nickel manganese cobalt oxide, ferric, etc.). Further, for example, the lighting device 100 may include one or more suitable electronic connectors, such as one or more USB ports (including micro-USB ports), which may be used to charge/recharge the battery 130 from an external power source and/or used to charge external devices, such as a mobile phone, from power stored in the battery 130. According to some examples herein, the lighting device 100 may be configured to recharge via USB cable in about 4 to 8 hours, e.g., about 5 to 6 hours, and/or to recharge via the solar panel 150 in about 18 to 30 hours, e.g., about 24 to 25 hours. The solar panel(s) 150 may allow for recharging the battery 130 in less than 24 hours in direct sunlight, such as less than 18 hours, less than 14 hours, less than 12 hours, or less than 8 hours, e.g., from 6 hours to 18 hours, or from 12 hours to 14 hours in direct sunlight.

Figure 3B:
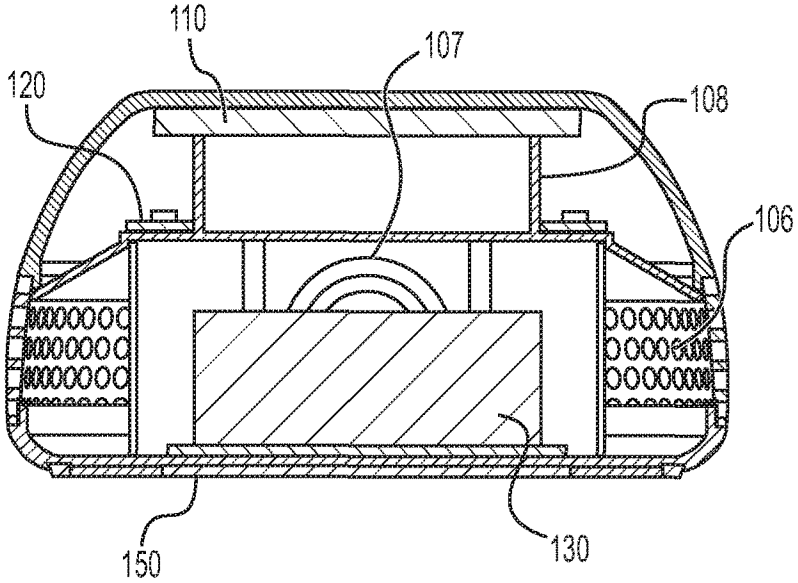
FIGS. 3A-3B show cross-sectional views of the exemplary lighting device of FIGS. 1A-1B.
Figure 3A:
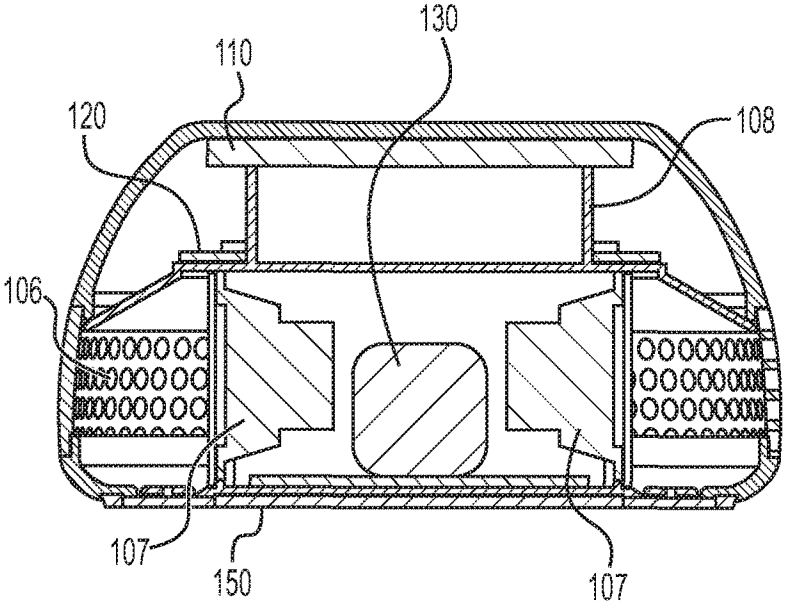

The housing of the lighting device 100 may be arranged such that the base 104 houses the speaker(s) 107 or otherwise secures the speaker(s) 107 in place. In at least one example, the base 104 may include features complementary to features of the section 106. As shown in FIG. 2, for example, the perimeter of the base 104 may include a ledge or recess that receives the lower end of the section, which may provide for a friction fit. The PCB 134 may be coupled to an inner surface of the base 104. As further illustrated in FIG. 2, the lighting device 100 may include two speakers 107 each facing outward (in opposite directions) towards the porous wall of the section 106. To secure the speakers 107, the base 104 may include an interior wall 116 having two spaces disposed opposite each other, the spaces having dimensions suitable for receiving a corresponding one of the speakers 107. FIGS. 3A and 3B show cross-sectional views of the lighting device 100, where the cross-section of FIG. 3B is 90 degrees to the cross-section of FIG. 3A. According to some examples herein, the battery 130 may be disposed between the two speakers 107, as illustrated in FIG. 3A. This arrangement is non-limiting and exemplary only.

Further referring to FIG. 2, the lighting device 100 may include a separator 108 between the base 104 and the cover 102. The separator 108 may comprise any of the materials discussed above for the base 104 and/or the cover 102. For example, the separator 108 may comprise ABS. The lower surface of the separator 108 may have the same cross-sectional dimension as the upper end of the section 106 and may be generally parallel to the lower surface of the base 104, such that the separator 108, the base 104, and the section 106 form an internal chamber. In this way, the separator 108 may serve to channel sound generated by the speakers 107 to the lower portion of the lighting device 100 and direct sound through the porous wall of the section 106. Similarly, the cover 102 may defined an internal chamber that houses the LED(s) 125. For example, the cover 102 and the separator 108 may form another chamber that, outside the chamber housing the speakers 107.

The upper surface of the separator 108 may serve as a support for the one or more LEDs 125. For example, the LED(s) 125 may be mounted or otherwise coupled to a substrate 120, illustrated in FIG. 2 as a ring, the substrate 120 being disposed on the upper surface of the separator 108. That is, the LED(s) 125 may face upwards, towards the cover 102. In some examples, the lighting device 100 may include a plurality of LEDs, optionally arranged at regular intervals such as in an annular configuration. In some examples, the lighting device 100 includes at least 2 LEDs, e.g., from 6 to 36 LEDs, from 10 to 24 LEDs, from 12 to 18 LEDs, or from 8 to 20 LEDs, from 24 to 36 LEDs. The LEDs 125 may be all white LEDs, all colored (RGB) LEDs, or a combination thereof. For example, the lighting device 100 may include from 8 to 16 white LEDs, e.g., 12 white LEDs, and from 2 to 10 RGB LEDs, e.g., 6 RGB LEDs.

In some examples, the LED(s) 125 may generate a light output ranging from about 10 lumens to about 350 lumens, such as about 50 lumens to about 300 lumens, about 100 lumens to about 300 lumens, or from about 150 lumens to about 250 lumens, e.g., about 180, 190, 200, 210, 220, 230, 240, or 250 lumens. The LED(s) 125 may have different intensity settings, e.g., a bright intensity (greater than or equal to 100 lumens, e.g., 220 lumens), a regular intensity (e.g., 50 to 100 lumens), and/or a low intensity (less than 50 lumens, e.g., 20 lumens). For example, the LED(s) 125 may have a light output of 100 lumens or greater, e.g., 120 lumens or greater, or 150 lumens or greater.

Further, for example, the rechargeable battery 130 may provide sufficient power for illuminating the LEDs 125 on a low setting (20 lumens) for at least 12 hours, at least 15 hours, or at least 20 hours, e.g., from 6 hours to 30 hours, or from 18 hours to 24 hours. Additionally or alternatively, the battery 130 may provide sufficient power for illuminating the LEDs 125 at a high setting (220 lumens) for at least 2 hours or at least 4 hours, e.g., from about 3 hours to about 5 hours.

The microprocessor or integrated circuit chip may be configured to control one or more operating modes of the lighting device 100, e.g., visual and/or acoustic modes. For example, the lighting device 100 may include one or more operating modes of the speaker(s) 107 (e.g., on/off, preset sounds, alarm, volume), one or more operating modes of the LED(s) 125 (e.g., on/off, intensity, color, color transitions), and/or one or more operating modes that combine operation of the speaker and the LED(s) (e.g., mood lighting combined with relaxing sounds, or flashing light combined with an alarm). As mentioned above, the lighting device 100 may include a touch sensitive snooze button and/or display screen (e.g., in the form of touchscreen 110) to terminate or change between operating modes, such as a preset alarm stored in the microprocessor of the PCB 134.

At least one operating mode of the lighting device 100 may include playing music from an external device, such as a mobile phone, MP3 player or other audio player, etc., through the speaker(s) 107 of the device 100. Further, for example, various operating modes of the lighting device 100 may be preprogrammed into the microprocessor, such that a user may select among the operating modes via physical input and/or wireless input. Exemplary preset operating modes may include, but are not limited to, color transitions to simulation circadian rhythm for waking up, color transitions (e.g., soothing gentle color transitions from red to blue and/or vice versa over time), and different soundscapes.

For example, the lighting device 100 may include one or more operating modes for generating various sounds, including, but not limited to, white noise, ocean sounds (e.g., crashing waves), babbling brook, rainfall, wind, or bird sounds, among other natural or environmental sounds. Additionally or alternatively, the lighting device may include one or more operating modes for turning LEDs 125 on and off, adjusting intensity of light generated by the LED(s), and/or changing colors of the LED(s) (including initiating and/or cycling through color transitions). For example, the operating modes of the device 100 may include simulating a natural sunrise for natural wake-up, simulating a natural sunset to facilitate sleep, and/or mood or therapy lighting. Further, the operating modes optionally may combine light and sound. For example, the device 100 may be configured to modify light output from one or more LED(s) 125 according to the sound and/or rhythm of music generated by the speaker(s) 107.

The lighting device 100 may include a screen (e.g., touchscreen 110) that allows for setting the time and/or an alarm, adjusting brightness of the LED(s) 125, adjusting volume of the speaker(s) 107, checking the battery charge level, and/or selecting preset values for light and/or sound. When the lighting device 100 is paired via Bluetooth, a user may connect and control the light through an app (e.g., an application of a smart phone or other mobile device), monitor sleep patterns, and/or play music or other audio files through a phone as a wireless/Bluetooth speaker. That is, the microprocessor may be configured to interface with the mobile device through the app, which may enable the mobile device to transmit various user inputs to control the microprocessor, and thus to control the lighting device 100. For example, the app may display a user interface as described in U.S. application Ser. No. 16/165,864 filed on Oct. 18, 2018, incorporated by reference herein. The user interface may include various options for users to select, including the option to select a color to be displayed by the lighting device 100 by changing the color(s) of the LED(s) 125. For example, a user may change the color of the lighting device 100 by selecting a preset color and/or by making a customized selection via a color wheel.

The lighting devices herein may be relatively compact and/or lightweight to promote portability. For example, the lighting device 100 may have a total weight less than 12 ounces, less than 10 ounces, or less than 8 ounces, e.g., a weight of 4 to 12 ounces, or 6 to 10 ounces. Further, for example, the maximum cross-sectional dimension may be less than or equal to 6 inches, less than or equal to 5 inches, or less than or equal to 4 inches, e.g., from about 4 to 5 inches.

What is claimed is:

1. A lighting device comprising:

a housing including a first chamber and a second chamber;

a solar panel coupled to an outer surface of the housing;

at least one speaker disposed within the first chamber, the housing comprising a textile material radially outward of the at least one speaker to permit the passage of sound therethrough;

at least one rechargeable battery;

a microprocessor; and a plurality of light sources disposed within the second chamber, the plurality of light sources configured to emit light in a direction opposite the solar panel and through a portion of the housing that is at least partially transparent or translucent;

wherein the solar panel, the at least one rechargeable battery, the microprocessor, the at least one speaker, and the plurality of light sources are in electronic communication with one another; and wherein the microprocessor is configured to control at least one operating mode of the plurality of light sources and at least one operating mode of the at least one speaker.

2. The lighting device of claim 1, wherein the housing is water-resistant.

3. The lighting device of claim 1, wherein the housing has a cross-sectional profile that is circular, oval, square, or rectangular.

4. The lighting device of claim 1, wherein the housing includes a separator between the first chamber and the second chamber, the separator permitting transmission of sound therethrough.

5. The lighting device of claim 4, wherein the separator includes the textile material.

6. The lighting device of claim 1, wherein the lighting device is configured to receive user input physically, wirelessly, or both physically and wirelessly, for controlling a plurality of operating modes of the plurality of light sources and a plurality of operating modes of the at least one speaker.

7. The lighting device of claim 6, wherein the plurality of operating modes of the plurality of light sources includes changing light intensity, changing color, changing power state, transitioning between colors, or a combination thereof.

8. The lighting device of claim 6, wherein the plurality of operating modes of the at least one speaker includes emitting an alarm, changing volume, changing power state of the at least one speaker, or a combination thereof.

9. The lighting device of claim 6, wherein the plurality of operating modes of the at least one speaker includes generating preset sounds, generating a soundscape, or playing music from an external device.

10. The lighting device of claim 1, wherein the lighting device comprises a cover that includes the portion of the housing that is at least partially transparent or translucent, the second chamber being defined by the cover.

11. The lighting device of claim 1, wherein the microprocessor is configured to control the at least one operating mode of the plurality of light sources in combination with the at least one operating mode of the at least one speaker, such that the plurality of light sources emit light according to a sound generated by the at least one speaker.

12. The lighting device of claim 1, wherein the textile material overlays a portion of the housing that is perforated.

13. The lighting device of claim 1, wherein the plurality of light sources includes light-emitting diodes (LEDs) arranged in an annular configuration.

14. The lighting device of claim 1, wherein the lighting device includes a button configured to receive user input to turn the plurality of light sources on and off and to turn wireless communication features on and off.

15. A lighting device comprising:

a housing including:

a first chamber; and a second chamber outside of the first chamber;

a solar panel coupled to an outer surface of the housing;

at least one speaker disposed within the first chamber and radially inward of a portion of the housing that comprises a textile material;

at least one rechargeable battery;

a microprocessor; and a plurality of light-emitting diodes (LEDs) within the second chamber;

wherein the solar panel, the rechargeable battery, the microprocessor, the at least one speaker, and the plurality of LEDs are in electronic communication with one another.

* * * * *